US006211757B1

(12) United States Patent
Castonguay et al.

(10) Patent No.: US 6,211,757 B1
(45) Date of Patent: Apr. 3, 2001

(54) FAST ACTING HIGH FORCE TRIP ACTUATOR

(75) Inventors: Roger N. Castonguay, Terryville; James L. Rosen, West Hartford; Dave Christensen, Harwinton; Girish Hassan, Plainville, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/518,899

(22) Filed: Mar. 6, 2000

(51) Int. Cl.[7] ..... H01H 75/00; H01H 77/00; H01H 83/00; H01H 9/00

(52) U.S. Cl. ..... 335/6; 335/10; 335/21; 335/26; 335/172; 335/174; 335/175

(58) Field of Search ..... 335/6, 9, 10, 21, 335/26, 172–176

(56) References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanatusa | 335/16 |
| 3,631,369 | 12/1971 | Menocal | 337/110 |
| 3,803,455 | 4/1974 | Willard . | |
| 3,883,781 | 5/1975 | Cotton . | |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,301,435 * | 11/1981 | Castonguay et al. | 335/26 |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |

(List continued on next page.)

FOREIGN PATENT DOCUMENTS

| | | |
|---|---|---|
| 819 008 | 12/1974 | (BE) . |
| 897 691 | 1/1984 | (BE) . |
| 12 27 978 | 11/1966 | (DE) . |

(List continued on next page.)

*Primary Examiner*—Ray Barrera
(74) *Attorney, Agent, or Firm*—Cantor Colburn LLP; Carl B. Horton

(57) ABSTRACT

A trip actuator (66) includes a trip spring (106) to bias the trip arm (104) in a clockwise direction about trip arm pivot (120). In the latched and ready to operate state, the clockwise moment about the axis of the latch pivot (132) created by force "F" opposes the counterclockwise moment created about the axis of the latch pivot (132) created by the horizontal component "$f_x$" of force "f", to hold the latch (110) in the upright position against the force of the trip arm (104). When a trip (triggering) signal is provided to the flux shifter (102), the flux shifter (102) releases the plunger (130). With the force "F" removed, the trip arm (104) will drive the latch pin (134), causing the latch (110) to rotate counterclockwise about the latch pivot (132). As the latch (110) and trip arm (104) rotate, the latch pin (134) slides off the latch surface (126), fully releasing the trip arm (104) and allowing the trip paddle (96) to move the secondary latch tab (50).

20 Claims, 7 Drawing Sheets

U.S. PATENT DOCUMENTS

| | | | |
|---|---|---|---|
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gaillard et al. | 335/42 |
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/331 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleu et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 200/148 A |
| 4,937,706 | 6/1990 | Schueller et al. | 361/396 |
| 4,939,492 | 7/1990 | Raso et al. | 335/42 |
| 4,943,691 | 7/1990 | Mertz et al. | 200/151 |
| 4,943,888 | 7/1990 | Jacob et al. | 361/96 |
| 4,950,855 | 8/1990 | Bolonegeat-Mobleu et al. | 200/148 |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 200/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,239,150 | 8/1993 | Bolongeat-Mobleu et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 200/148 R |
| 5,281,776 | 1/1994 | Morel et al. | 200/144 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleu et al. | 200/148 B |
| 5,347,097 | 9/1994 | Bolongeat-Mobleu et al. | 200/148 B |
| 5,350,892 | 9/1994 | Rozier | 200/144 B |
| 5,357,066 | 10/1994 | Morel et al. | 200/17 R |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barionnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |
| 5,493,083 | 2/1996 | Olivier | 200/17 R |
| 5,504,284 | 4/1996 | Lazareth et al. | 200/50 R |
| 5,504,290 | 4/1996 | Baginski et al. | 200/401 |
| 5,510,761 | 4/1996 | Boder et al. | 335/172 |
| 5,512,720 | 4/1996 | Coudert et al. | 200/400 |
| 5,515,018 | 5/1996 | DiMarco et al. | 335/16 |
| 5,519,561 | 5/1996 | Mrenna et al. | 361/105 |
| 5,534,674 | 7/1996 | Steffens | 218/154 |
| 5,534,832 | 7/1996 | Duchemin et al. | 335/16 |
| 5,534,835 | 7/1996 | McColloch et al. | 335/172 |
| 5,534,840 | 7/1996 | Cuingnet | 337/1 |
| 5,539,168 | 7/1996 | Linzenich | 200/303 |
| 5,543,595 | 8/1996 | Mader et al. | 200/401 |
| 5,552,755 | 9/1996 | Fello et al. | 335/18 |
| 5,581,219 | 12/1996 | Nozawa et al. | 335/132 |
| 5,604,656 | 2/1997 | Derrick et al. | 361/187 |
| 5,608,367 | 3/1997 | Zoller et al. | 335/132 |
| 5,784,233 | 7/1998 | Bastard et al. | 361/36 |

FOREIGN PATENT DOCUMENTS

| | | |
|---|---|---|
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 1 227 978 | 4/1994 | (SU) . |
| 92/00598 | 1/1992 | (WO) . |
| 92/05649 | 4/1992 | (WO) . |
| 94/00901 | 1/1994 | (WO) . |

* cited by examiner

FAST ACTING HIGH FORCE TRIP ACTUATOR

BACKGROUND OF THE INVENTION

The present invention relates to a circuit breaker trip actuator, and, more particularly, to a fast acting, high force trip actuator.

Modem circuit breakers rely on electronics for the detection of potentially damaging over-current conditions. These electronics, known as trip units, sense current in a protected portion of an electrical distribution circuit and initiate a trip signal if the sensed current indicates an over-current condition. In such circuit breakers, an electromechanical actuator, known as a trip actuator or trip mechanism, is used to unlatch a circuit breaker operating mechanism in response to the trip signal. The operating mechanism is a spring-operated linkage arrangement. When unlatched, the operating mechanism separates a pair of main contacts to stop the flow electrical current to the protected portion of the distribution circuit. The operation of such circuit breakers is well known.

During the operation of the circuit breaker, it is desirable to part the main contacts is fast is possible after a trip signal is given by the electronic trip unit. Opening the contacts faster minimizes the arcing energy seen by the main contact structure, prolonging contact life.

The trip actuator is responsible for a large part of the time required in releasing these contacts. Typically, a trip actuator includes a solenoid or flux shifter that pushes or releases an actuating arm in response to the trip signal. The trip actuator also typically includes a mechanical linkage arrangement that translates the action of the actuating arm into a force that will unlatch the operating mechanism.

Increases in the speed or power of trip actuators have been accomplished through the use of a larger solenoid or flux shifter. However, the use of a larger solenoid or flux shifter requires that the trip unit to provide a higher firing voltage (trip signal) to the solenoid or flux unit. In addition, the larger solenoid or flux unit requires a greater amount of space in a tight circuit breaker housing.

BRIEF SUMMARY OF THE INVENTION

In an exemplary embodiment of the invention, a trip actuator for actuating an operating mechanism in a circuit breaker includes a trip arm biased to pivot in a first direction about a first axis and a latch arranged to pivot about a second axis. The trip arm acts on the latch at a first distance from the second axis to create a moment in a second direction about the second axis. The trip actuator also includes an electromechanical device with a plunger. The plunger acts on the latch at a second distance from the second axis to create a moment in the first direction about the second axis. The second distance is greater than said first distance. When a trip actuation signal is provided to the electromechanical device, the electromechanical device releases the plunger to allow the trip arm to pivot in the first direction and actuate the operating mechanism.

This invention has many advantages over the prior art, one of which includes the ability to increase the speed and power of the trip actuator without increasing the size or firing voltage of the electromechanical device.

DETAILED DESCRIPTION OF THE INVENTION

Figure 1:
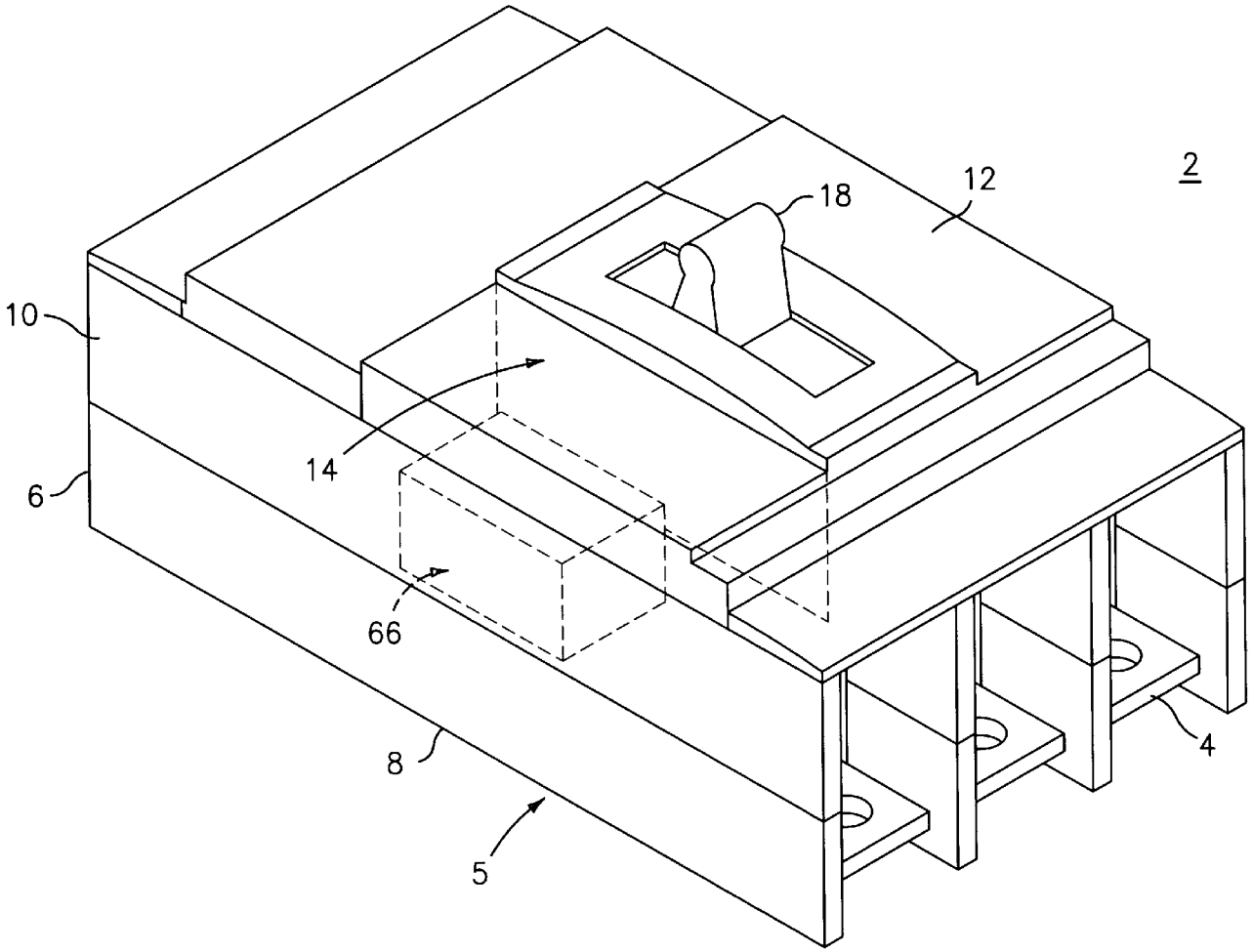
FIG. 1 is a perspective view of a circuit breaker.

A top perspective view of a molded case circuit breaker 2 is provided at FIG. 1. Molded case circuit breaker 2 is generally interconnected within a protected circuit between multiple phases of a power source (not shown) at line end 4 and a load to be protected (not shown) at load end 6. Molded case circuit breaker 2 includes a housing 5 with a base 8, a mid cover 10 and a top cover 12. An operating handle 18 passes through top cover 12 and interconnects with a circuit breaker operating mechanism 14. A trip actuator 66 is generally positioned within mid cover 10.

Figure 2:
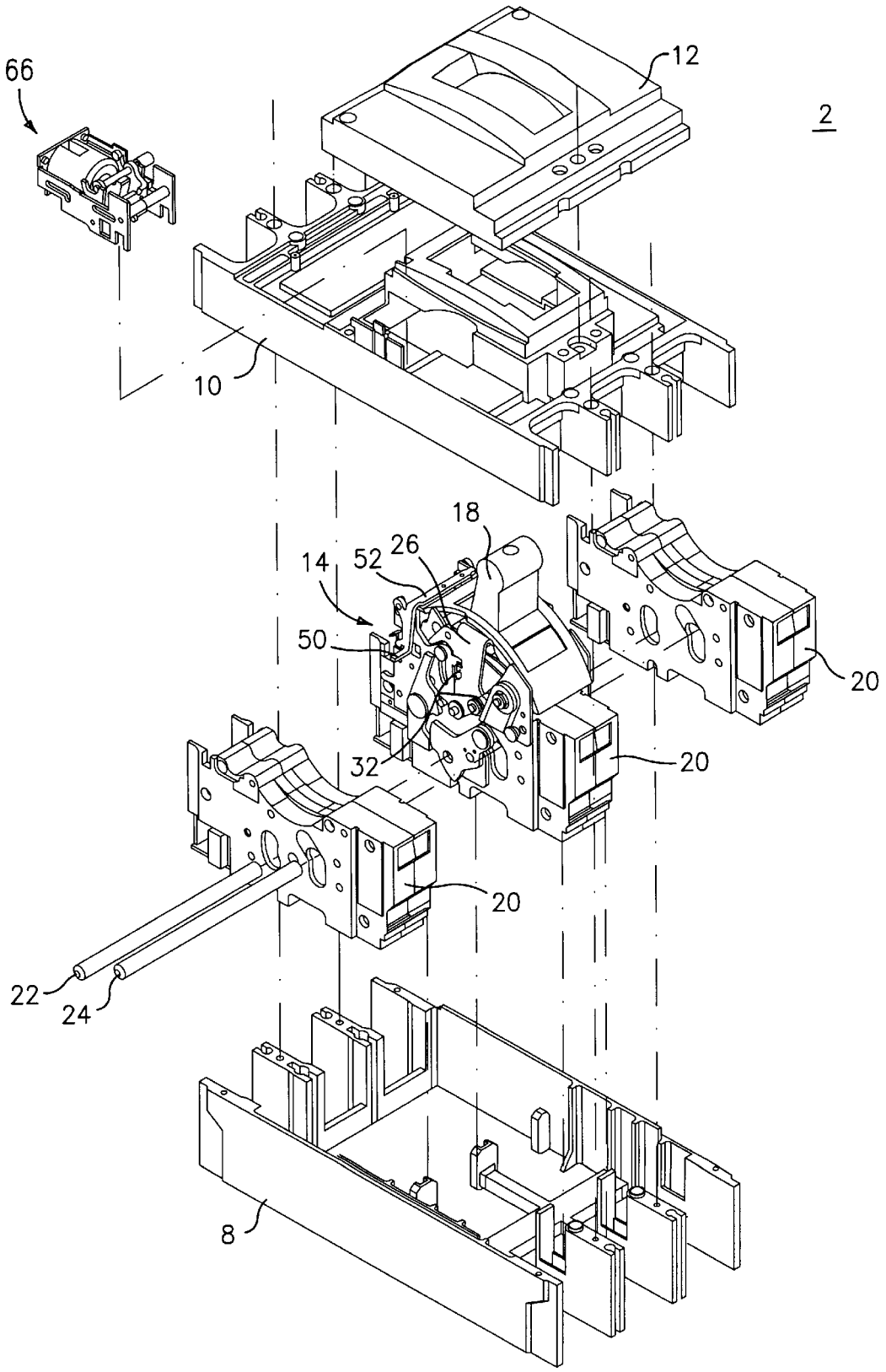
FIG. 2 is an exploded perspective view of a circuit breaker including a trip actuator of the present invention.

Referring now to FIG. 2, an exploded view of molded case circuit breaker 2 is provided. A series of circuit breaker cassettes 20 are generally well known and may be, for example, of the rotary type. Circuit breaker cassettes 20 are seated approximately upstanding within base 8, and one of the cassettes 20 includes operating mechanism 14 positioned thereon. One cassette 20 is provided for each phase of the electrical distribution circuit. Each cassette 20 includes one or more contact pairs therein for passage of current when the contacts are closed and for preventing passage of current when the contact pairs are opened. Each cassette 20 is commonly operated by a first bar 22 and a second bar 24 that interface with the internal mechanisms of cassettes 20 and with operating mechanism 14 such that operating mechanism 14 operates all cassettes 20. It is contemplated that the number of phases, or specific type of cassette utilized, can vary according to factors including, but not limited to, the type of load circuit being protected and the type of line input being provided to the circuit breaker 2.

Figure 3:
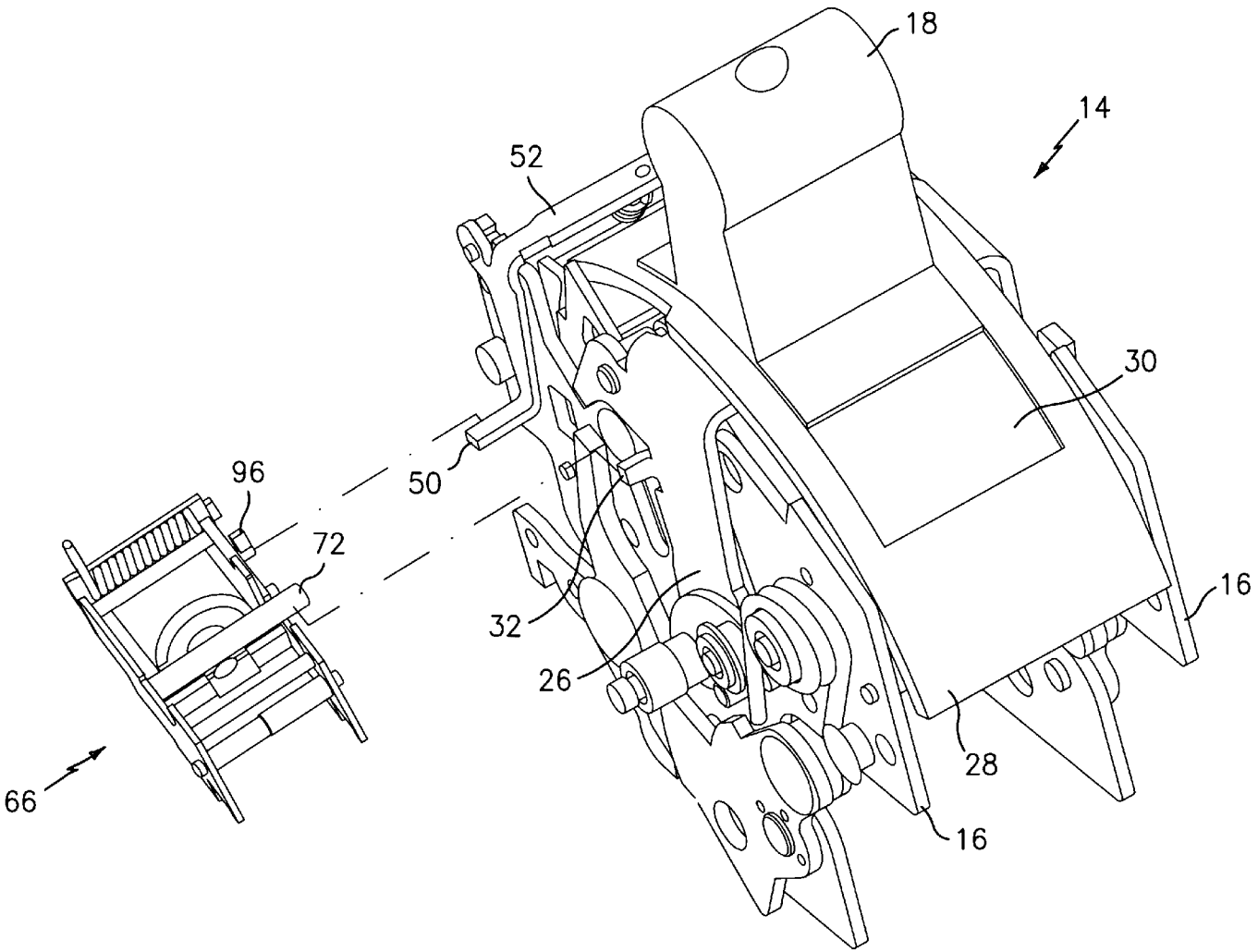
FIG. 3 is a perspective view of the trip actuator and operating mechanism of FIG. 2.

Referring to FIG. 3, circuit breaker operating mechanism 14 includes a frame 16 having spaced apart sidewalls. An operating handle-yoke 26 generally fits over frame 16. Operating handle 18 is interconnected with operating handle-yoke 26. Operating mechanism 14 includes an operating mechanism cover 28 with a handle opening 30 formed therein allowing operating handle 18 to pass therethrough. Handle-yoke 26 includes a reset tab 32 depending generally perpendicularly therefrom to allow interface with trip actuator 66, and more specifically to interact with a reset tab 72 of trip actuator 66. Frame 16 includes a secondary latch 52 pivotally secured thereto. Secondary latch 52 includes a secondary latch tab 50 depending generally perpendicularly therefrom. Secondary latch tab 50 interfaces with a trip paddle 96 extending from trip actuator 66.

Upon assembly, trip actuator 66 is positioned such that the trip paddle 96 is adjacent to latch tab 50, and a reset tab 72 is adjacent to reset tab 32. This is generally accomplished by seating trip actuator 66 alongside operating mechanism 14 within mid cover 10 (FIGS. 1 and 2).

Figure 4:
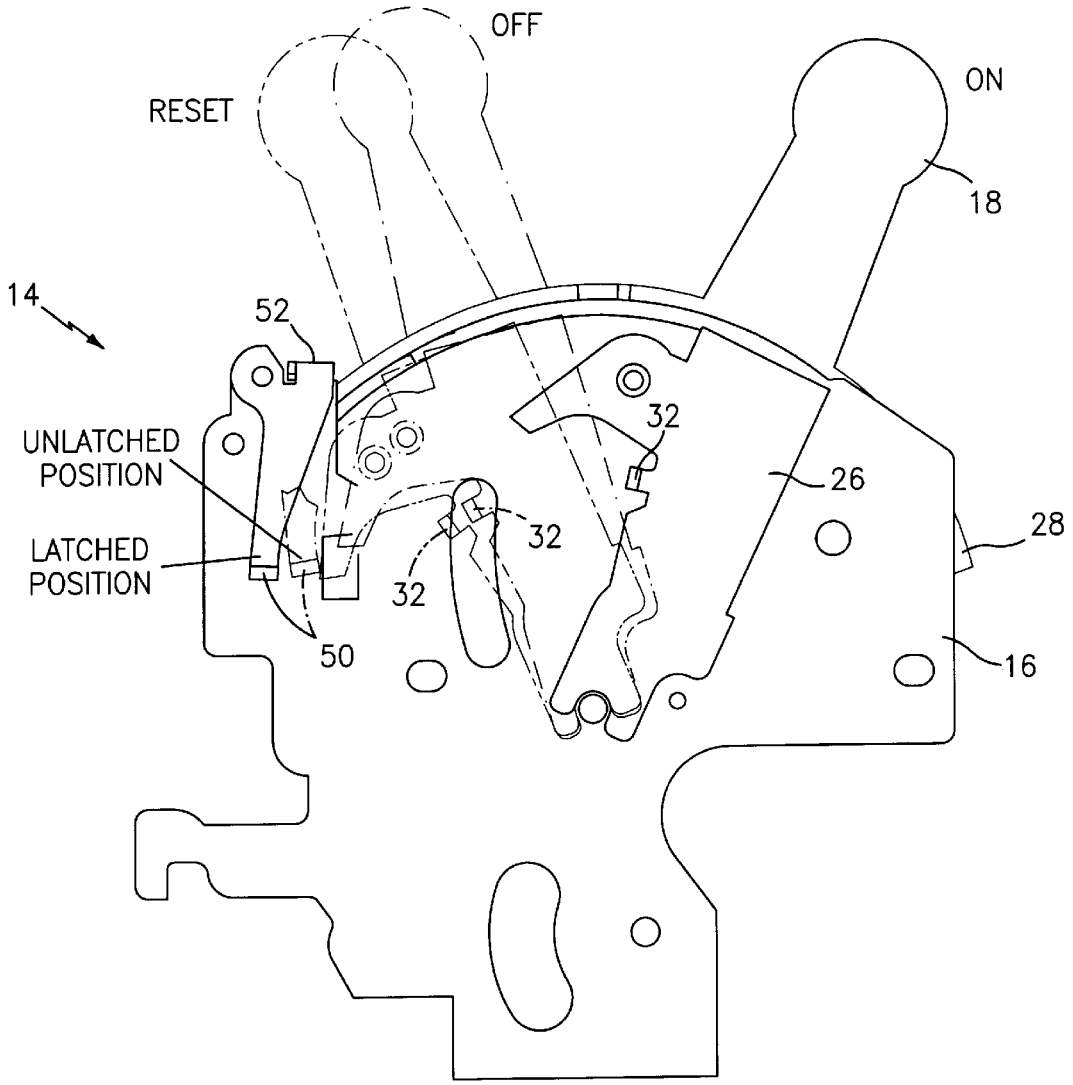
FIG. 4 is a side view depicting the general operation of the circuit breaker operating mechanism of FIG. 3.

Referring to FIGS. 3 and 4, the operation of the circuit breaker operating mechanism 14 will be generally described. FIG. 4 shows the operating mechanism 14 in three discrete positions: the "ON" position, the "OFF" position and the "RESET" position. Upon activation of trip actuator 66, trip paddle 96 will be displaced generally in a forward direction (toward reset tab 72) and will contact latch trip tab 50, displacing tab 50 from the "Latched" position to the "Unlatched" position as shown in FIG. 3. This will release latch 52 allowing operating mechanism 14 to move from the "ON" position to a "TRIPPED" position (not shown), opening the set of circuit breaker contacts (not shown). In the "TRIPPED" position, handle 18 is located between the "ON" and "OFF" positions shown. Before operating handle 18 may be returned to the quiescent operation position (i.e., "ON"), circuit breaker operating mechanism 14 and trip actuator 66 must be reset. This is accomplished by manually rotating operating handle 18 in the counter-clockwise direction against the forces of one or more springs (not shown) to the "RESET" position, thereby moving the secondary latch 52 of operating mechanism 14 from the "Unlatched" position to the "Latched" position. The motion of operating handle 18 rotates reset tab 32, thereby driving reset tab 72 towards trip paddle 96 to reset trip actuator 66, as will be described in further detail hereinafter.

Figure 5:
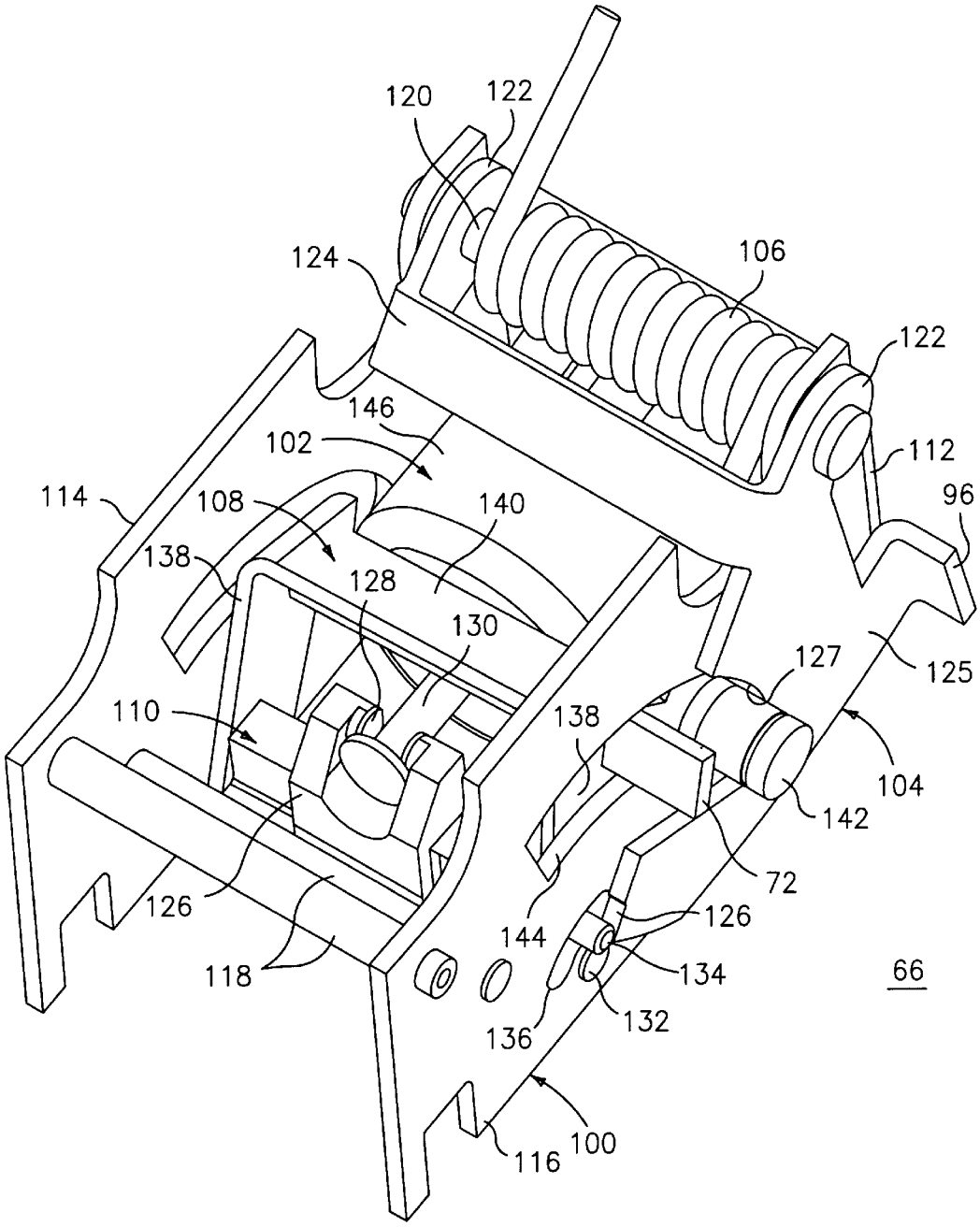
FIG. 5 is a perspective view of the trip actuator of FIG. 3 in a reset state.

Referring to FIG. 5, a perspective view of trip actuator 66 is shown. Trip actuator 66 includes a frame 100, an electromechanical device such as a flux shifter 102, a trip arm 104, a trip spring 106, a reset lever 108, and a latch 110. Frame 100 includes a back wall 112 with two sidewalls 114, 116 depending substantially perpendicular therefrom. The sidewalls 114, 116 extend substantially parallel to each other, and are joined by a frame pins 118 that extend from side wall 114 to side wall 116. Frame 100 is preferably formed from a single plate of metal.

Trip arm 104 is hingedly secured to sidewalls 114, 116 by a trip arm pivot 120, which extends from side wall 114 to side wall 116. Trip arm 104 includes two hinge portions 122 which accept trip arm pivot 120, and a hinge support portion 124 that extends between hinge portions 122. Trip arm 104 also includes a latch portion 125 that extends downwardly from support portion 124 and along the outside of side wall 116. Trip paddle 96 depends substantially perpendicularly latch portion 125. A latch surface 126 is formed on an edge of latch portion 125 opposite the trip paddle 96. Trip arm 104 is preferably formed from a single plate of metal.

Trip spring 106 is shown as a torsion spring disposed around trip arm pivot 120. One end of trip spring 106 is secured to the circuit breaker mid cover 10 (FIG. 2), while the other end is positioned beneath the hinge support portion 124 of the trip arm 104. When installed in mid cover 10, trip spring 106 acts to bias trip arm 104 in the clockwise direction, as shown in FIG. 5.

Latch 110 is formed as a substantially rectangular shaft having a boss 126 disposed on a central portion thereof. A slot 128 formed in boss 126 accepts the head of a plunger 130, which extends from flux shifter 102. The ends of latch 110 are pivotally secured to frame sidewalls 114 and 116 by a latch pivot 132. A latch pin 134 is secured to an end of latch 110, and extends from latch 110 through an arcuate slot 136 disposed in side wall 116. Latch pin 134 is arranged to interact with the latch surface 126 of trip arm 104 in a manner described hereinbelow.

Reset lever 108 includes side arms 138 that extend from a central support 140. Side arms 138 extend along side walls 114, 116 and are pivotally secured to side walls 114, 116 by latch pivot 132. Reset tab 72 and a reset pin 142 depend substantially perpendicularly from the side arm 138 proximate side wall 116. Reset tab 72 and reset pin 142 extend through an arcuate slot 144 formed in sidewall 116.

Flux shifter 102 is an electromechanical device mounted to rear wall 112 of the frame 100. The construction and operation of flux shifter 102 is known in the art and is similar in operation to that described in U.S. Patent No. 5,453,724. Flux shifter 102 includes the plunger 130, which slidably extends from a body 146. Plunger 130 is releasably secured by a magnet (not shown) within body 146. Flux shifter 102 is arranged to receive a triggering signal (e.g., a trip signal) from an electrical device (e.g., a trip unit). Upon receipt of the triggering signal, a coil (not shown) in the flux shifter 102 shunts out the magnet, and the plunger 130 is released from the magnet. Once released by the magnet, the plunger 130 is free to extend outward from the body 146.

Figure 6:
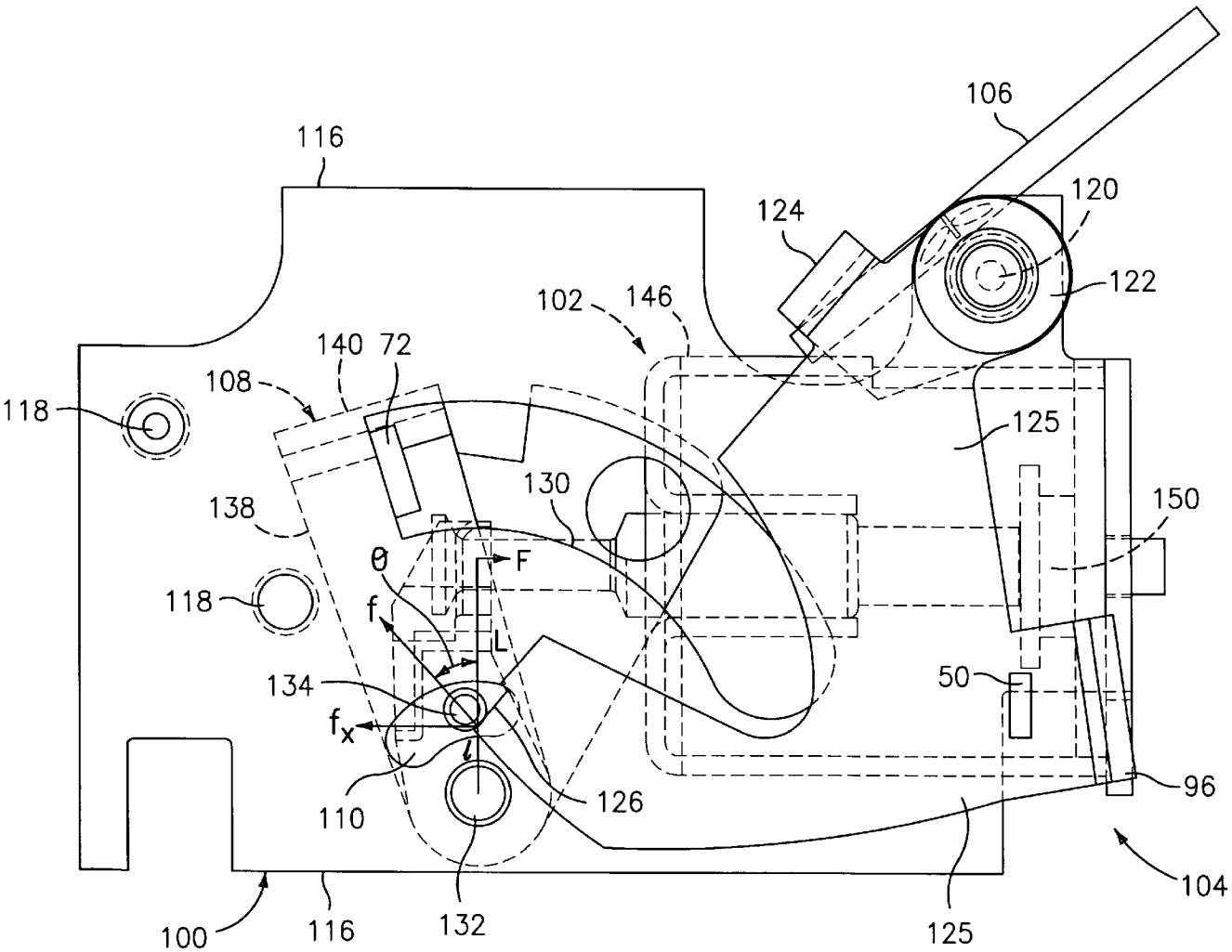
FIG. 6 is a side view of the trip actuator of FIG. 3 in a latched and ready to operate state.
Figure 7:
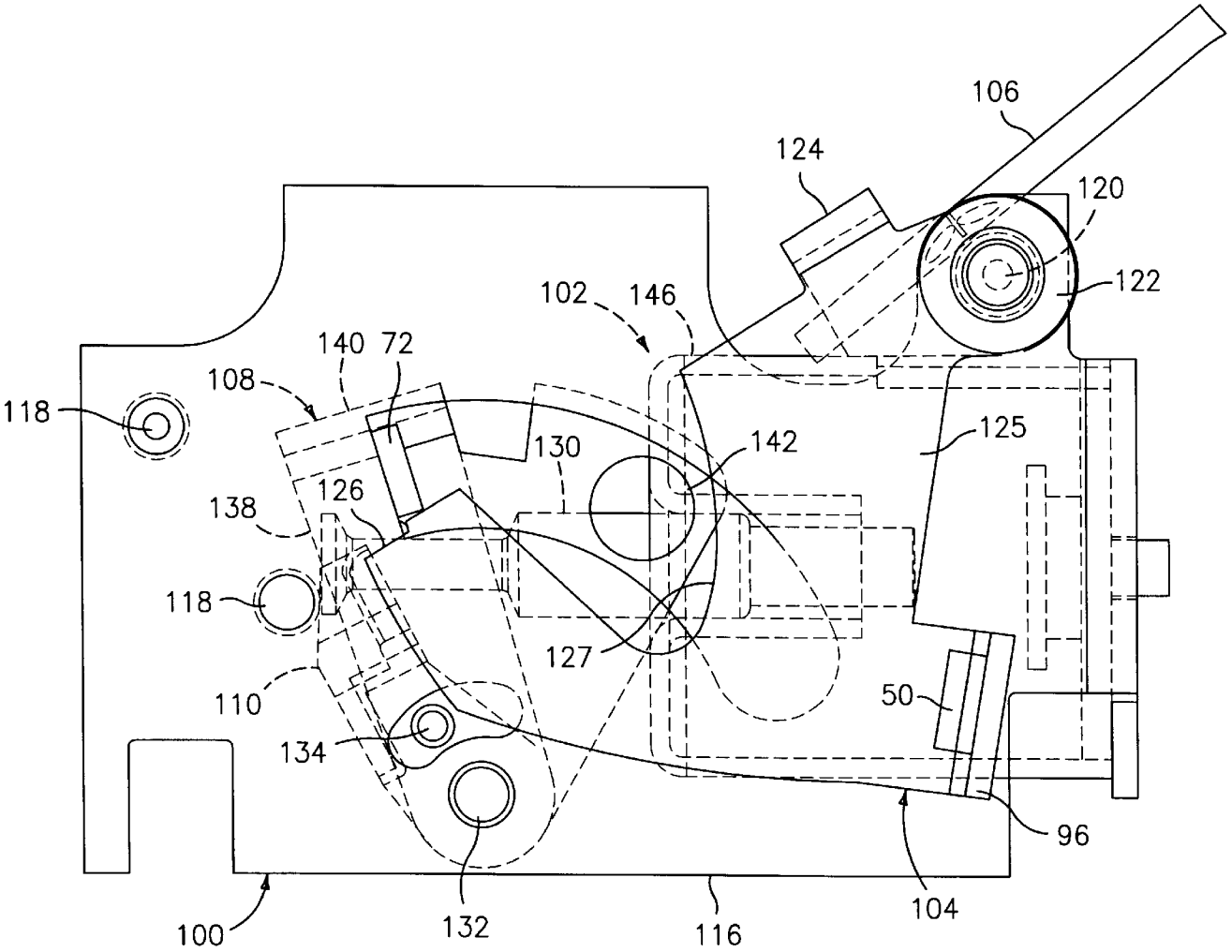
FIG. 7 is a side view of the trip actuator of FIG. 3 in a tripped released state.

Referring to FIGS. 5, 6, and 7, operation of the trip actuator 66 will now be described. FIG. 6 shows the trip actuator 66 in a latched and ready to operate state. In this state, the trip spring 106 is loaded to bias the trip arm 104 in a clockwise direction about the longitudinal axis of trip arm pivot 120. The latch surface 126 of the trip arm 104 acts with a force "f" against the latch pin 134. Latch surface 126 is configured such that the force "f" is directed at an angle "θ" past a line formed between the longitudinal axis of latch pivot 132 and the point of contact between the latch surface 126 and latch pin 134. The directional component "$f_x$" of force "f" creates a counterclockwise moment about the axis of latch pivot 132, with a moment arm of length "l". The directional component "$f_y$" of force "f" acts through the longitudinal axis of latch pivot 132 and, therefore, does not add to the counterclockwise moment.

The latch 110 is held in an upright position by the plunger 130, and the plunger 130 is held in tension by a magnet 150 disposed in the body 146 of the flux shifter 102. The force "F" of the plunger 130 on the link 110 creates a clockwise moment about the axis of latch pivot 132, with a moment arm of length "L". In the latched and ready to operate state shown, the clockwise moment created by force "F" opposes the counterclockwise moment created by force "f", to hold the latch 110 in the upright position against the force of the trip arm 104. Because the moment arm "L" is much longer than moment arm "1", and because only the horizontal component "$f_x$" must be overcome, the force "F" needed to maintain the latch 110 in the upright position is much less than the force "f" applied by the trip arm 104. As a result, the magnet 150 need only provide a magnetic force sufficient to oppose force "F" and not the entire force "f" of the trip arm 104. Thus, by adjusting lengths "l" and "L" and the angle "θ", the force "f" provided by the trip arm 104 can be increased (e.g., by increasing the strength of spring 106) or decreased without having to increase or decrease the size of the flux shifter 102.

When a trip (triggering) signal is provided to the flux shifter 102, the coil (not shown) in the flux shifter 102 shunts out the magnetic circuit, releasing the plunger 130. With the force "F" removed, the trip arm 104 will drive the latch pin 134, causing the latch 110 to rotate counterclockwise about the latch pivot 132. As the latch 110 and trip arm 104 rotate about their respective pivots 132, 120, the latch pin 134 slides off the latch surface 126, fully releasing the trip arm 104 and allowing the trip paddle 96 to move towards and into contact with the secondary latch tab 50. The trip arm 104 may also contact one or more levers (not shown) to actuate other mechanisms, such as a bell alarm (not shown). Movement of secondary latch tab 50 trips the operating mechanism 14, as described with reference to FIG. 4 hereinabove. The trip actuator 66 comes to rest in the tripped released state shown in FIG. 7, where the latch 110 is prevented from rotating further in the counterclockwise direction by contact with the frame pin 118 and the trip arm 104 is prevented from rotating further in the clockwise direction by contact with the reset tab 72.

The trip actuator 66 is reset (i.e. placed in the latched and ready to operate state of FIG. 6) by the reset motion of the operating handle 18. As the operating handle 18 is rotated to the "RESET" position, as described with reference to FIG. 4, the reset tab 32 of the operating handle 18 pushes the reset tab 72 of the trip actuator 66. This action causes the reset lever 108 to pivot in a clockwise direction about latch pivot 132 and causes reset pin 142 to contact the reset surface 127 of the trip arm 104. Trip arm 104 is thus rotated in the counterclockwise direction. As the trip arm 104 is driven counterclockwise, the latch pin 134 is released from beneath the latch surface 126 allowing the plunger 130 to be drawn back into the body 146 of the flux shifter 102 by the magnet 150 (which is no longer being shunted by the triggering signal). As the plunger 130 is drawn back into the body 146, the plunger 130 causes the latch 110 to rotate to its upright position. With the latch 110 in its upright position, the trip arm 104 becomes latched, and the trip actuator 66 is in the latched and ready to operate state of FIG. 6.

The high force, fast acting trip actuator described herein allows the speed or power of the trip actuator to be increased without the need for a larger flux shifter or higher firing voltages, as was required in trip actuators of the prior art. Speed and power can be increased, for example, by increasing the strength of spring 106, and lengths "l" and "L" and the angle "θ" can be adjusted to allow the use of the same flux shifter or similar electromechanical device.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A trip actuator for actuating an operating mechanism in a circuit breaker, the trip actuator comprising:

a trip arm biased to pivot in a first direction about a first axis;

a latch arranged to pivot about a second axis, said trip arm acting on said latch at a first distance from said second axis to create a moment in a second direction about said second axis;

an electromechanical device including a plunger, said plunger acting on said latch at a second distance from said second axis to create a moment in said first direction about said second axis, said second distance being greater than said first distance; and wherein providing a signal to said electromechanical device releases said plunger to allow said trip arm to pivot in said first direction and actuate the operating mechanism.

2. The trip actuator of claim 1, further including:

a reset lever arranged to pivot about said second axis, said reset lever acting on said trip arm to pivot said trip arm in said second direction about said first axis.

3. The trip actuator of claim 1, wherein said electromechanical device is a flux shifter.

4. The trip actuator of claim 1, wherein said trip arm includes a latch surface formed thereon for contacting said latch, said latch surface being configured such that a directional component of the force of said trip arm on said latch acts through said second axis.

5. The trip actuator of claim 4, further including:

a frame including first and second sidewalls, said trip arm being pivotally attached to said first sidewall at said first axis, and said latch being pivotally attached to said first sidewall at said second axis.

6. The trip actuator of claim 5, wherein said electromechanical device is mounted to said frame.

7. The trip actuator of claim 5 wherein said latch is pivotally attached to said first and second sidewalls at said second axis, an end of said latch proximate said first sidewall includes a latch pin extending therefrom, said latch surface acting on said latch pin, and a central portion of said latch includes a boss disposed thereon, said boss having a slot formed therein for accepting said plunger.

8. The trip actuator of claim 5 wherein said trip arm includes:

first and second hinge portions, said first hinge portion being pivotally attached to said first sidewall and said second hinge portion being pivotally attached to said second sidewall;

a support portion extending from said first hinge portion to said second hinge portion; and a latch portion extending from said support portion and along said first sidewall, said latch portion including said latch surface formed thereon and a trip paddle extending therefrom, said trip paddle for actuating the operating mechanism.

9. The trip actuator of claim 5, further including, a reset lever arranged to pivot about said second axis, said reset lever acting on said trip arm to pivot said trip arm in said second direction about said first axis, said reset lever including:

a first side arm pivotally secured to said first sidewall at said second axis, a second side arm pivotally secured to said second sidewall at said second axis, and a central support extending from said first sidearm to said second sidearm.

10. The trip actuator of claim 9, wherein said first sidearm includes a pin disposed thereon, said pin acting on said trip arm to pivot said trip arm in said second direction about said first axis, said first sidearm further including a reset tab extending therefrom, said reset tab for interacting with the operating mechanism.

11. A circuit breaker for providing overcurrent protection to a protected load, the circuit breaker including:

a pair of separable contacts;

an operating mechanism arranged to separate said pair of separable contacts;

an operating handle interconnected to said operating mechanism; and a trip actuator arranged proximate said operating handle for actuating said operating mechanism, the trip actuator comprising:

a trip arm biased to pivot in a first direction about a first axis, a latch arranged to pivot about a second axis, said trip arm acting on said latch at a first distance from said second axis to create a moment in a second direction about said second axis, an electromechanical device including a plunger, said plunger acting on said latch at a second distance from said second axis to create a moment in said first direction about said second axis, said second distance being greater than said first distance, and wherein providing a signal to said electromechanical device releases said plunger to allow said trip arm to pivot in said first direction and actuate said operating mechanism to separate said contacts.

12. The circuit breaker of claim 11, further including:

a reset lever arranged to pivot about said second axis, said operating handle acting on said reset lever and said reset lever acting on said trip arm to pivot said trip arm in said second direction about said first axis.

13. The circuit breaker of claim 11, wherein said trip arm includes a latch surface formed thereon for contacting said latch, said latch surface being configured such that a directional component of the force of said trip arm on said latch acts through said second axis.

14. The circuit breaker of claim 13, wherein said trip actuator further includes:

a frame including first and second sidewalls, said trip arm being pivotally attached to said first sidewall at said first axis, and said latch being pivotally attached to said first sidewall at said second axis.

15. The circuit breaker of claim 14, wherein said electromechanical device is mounted to said frame.

16. The circuit breaker of claim 14 wherein said latch is pivotally attached to said first and second sidewalls at said second axis, an end of said latch proximate said first sidewall includes a latch pin extending therefrom, said latch surface acting on said latch pin, and a central portion of said latch includes a boss disposed thereon, said boss having a slot formed therein for accepting said plunger.

17. The circuit breaker of claim 14 wherein said trip arm includes:

first and second hinge portions, said first hinge portion being pivotally attached to said first sidewall and said second hinge portion being pivotally attached to said second sidewall;

a support portion extending from said first hinge portion to said second hinge portion;

a latch portion extending from said support portion and along said first sidewall, said latch portion including said latch surface formed thereon and a trip paddle extending therefrom, said trip paddle for actuating the operating mechanism.

18. The circuit breaker of claim 14, further including, a reset lever arranged to pivot about said second axis, said reset lever acting on said trip arm to pivot said trip arm in said second direction about said first axis, said reset lever including:

a first side arm pivotally secured to said first sidewall at said second axis, a second side arm pivotally secured to said second sidewall at said second axis, and a central support extending from said first sidearm to said second sidearm.

19. The circuit breaker of claim 18, wherein said first sidearm includes a pin disposed thereon, said pin acting on said trip arm to pivot said trip arm in said second direction about said first axis, said first sidearm further including a reset tab extending therefrom, said reset tab for interacting with the said operating mechanism.

20. The circuit breaker of claim 18, wherein said electromechanical device is a flux shifter.

* * * * *